US005147699A

United States Patent [19]

Browning et al.

[11] Patent Number: 5,147,699

[45] Date of Patent: Sep. 15, 1992

[54] DISTRIBUTION LABEL

[75] Inventors: Jovona C. Browning, Miamisburg, Ohio; Vernon B. Harvey, Florence, S.C.

[73] Assignee: NCR Corporation, Dayton, Ohio

[21] Appl. No.: 637,844

[22] Filed: Jan. 7, 1991

[51] Int. Cl.[5] ..... A61F 13/02

[52] U.S. Cl. ..... 428/40; 428/41; 428/42; 428/43; 428/124; 428/126; 428/130; 428/136; 428/354; 283/81; 462/26

[58] Field of Search ..... 428/40, 41, 42, 43, 428/136, 130, 124, 126, 354; 282/12 A; 283/81

[56] References Cited

U.S. PATENT DOCUMENTS

| | | | |
|---|---|---|---|
| 3,035,957 | 5/1962 | Morgan | 428/41 |
| 3,226,862 | 1/1966 | Gabruk | 428/43 |
| 3,993,814 | 11/1976 | Cavender | 428/40 |
| 4,110,502 | 8/1978 | Baer | 428/40 |
| 4,323,608 | 4/1982 | Denny | 428/43 |
| 4,551,373 | 11/1985 | Conlon | 428/43 |
| 4,592,572 | 6/1986 | Instance | 281/2 |
| 4,598,935 | 7/1986 | Stewart | 283/81 |
| 4,627,994 | 12/1986 | Welsch | 428/43 |
| 4,699,833 | 10/1987 | Instance | 428/42 |
| 4,708,368 | 11/1987 | Instance | 283/81 |
| 4,711,686 | 12/1987 | Instance | 156/227 |
| 4,744,161 | 5/1988 | Instance | 40/2 R |
| 4,744,591 | 5/1988 | Instance | 281/5 |
| 4,747,618 | 5/1988 | Instance | 281/5 |
| 4,830,406 | 5/1989 | Instance | 283/81 |
| 4,850,612 | 7/1989 | Instance | 281/5 |
| 4,850,613 | 7/1989 | Instance | 281/5 |
| 4,894,106 | 1/1990 | Instange | 428/40 |
| 4,927,179 | 5/1990 | Ehret et al. | 283/79 |
| 4,955,640 | 9/1990 | Anderson | 281/2 |
| 5,030,491 | 7/1991 | Shoesmith | 428/43 |

*Primary Examiner*—Ellis P. Robinson
*Assistant Examiner*—Nasser Ahmad
*Attorney, Agent, or Firm*—George J. Muckenthaler

[57] ABSTRACT

A business form has a plurality of portions used as labels for carrying data or information and such labels are placed on packages or containers in transit. The business form has at least one portion which is folded under another portion and the form includes lines of perforations and slits for enabling the folding and for separation of certain parts. An address label has edge portions secured to the package or container and at least one edge portion is designed to be conveniently released from a release liner carrying the labels.

18 Claims, 3 Drawing Sheets

DISTRIBUTION LABEL

BACKGROUND OF THE INVENTION

In the area of delivery services, packages or like containers are a common means to transport information and/or material between two businesses or other entities. It is common practice that such packages or containers carry information as to the contents thereof and/or the number of units or articles in the package. This identification or information is usually printed on a label or like business form that is attached to the package and that includes several portions for precise purposes. In effect, the label or like form may be called a distribution label that also includes a portion for price tags of the units or articles in the package or for other units or articles. In another application or use, the label or like form may contain a packing list which includes the contents of the package.

Representative documentation in the field of labels or like business forms used in attaching to packages includes U.S. Pat. No. 4,110,502, issued to J. Baer on Aug. 29, 1978, which discloses a label-price tag composite wherein the price tag portion with a backing strip is folded back under the central portion of the label leaving adhesive upper and lower portions which are pressed against a carton.

U.S. Pat. No. 4,592,572, issued to D. J. Instance on Jun. 3, 1986, discloses a resealable container label having a series of panels which are folded under and an overlapping portion of a front cover has adhesive for securing the front cover in a closed condition.

U.S. Pat. No. 4,699,833, issued to D. J. Instance on Oct. 13, 1987, discloses a label for attaching to a product and including a sheet portion and an envelope portion formed from a single folded sheet.

U.S. Pat. No. 4,708,368, issued to D. J. Instance on Nov. 24, 1987, discloses a label for affixing to a container and comprising a strip with four or more panels divided by fold lines, the first panel being wider than the other panels and the other panels being folded to allow a user to pull out panels.

U.S. Pat. No. 4,711,686, issued to D. J. Instance on Dec. 8, 1987, discloses a method for making labels.

U.S. Pat. No. 4,744,161, issued to D. J. Instance on May 17, 1988, discloses a label comprising a series of panels folded along fold lines, one panel extending beyond a rear cover panel and having an overlapping portion adhered to a support web to maintain the folded label.

U.S. Pat. No. 4,744,591, issued to D. J. Instance on May 17, 1988, discloses a label comprising a strip of panels divided by fold lines and having at least a front cover and a rear cover with adhesive material extending beyond an edge of the front panel to secure the front cover in a closed condition and which can be pulled open to give access to the interior panels.

U.S. Pat. No. 4,747,618, issued to D. J. Instance on May 31, 1988, discloses a label with a front cover having an outer edge with holes and adhesive to adhere the front cover to a support web and which can be pulled away to give access to the panels.

U.S. Pat. No. 4,830,406, issued to D. J. Instance on May 16, 1989, discloses a label with a series of panels folded along fold lines and having tear lines which divide the folded strip into a central portion and opposed edge portions. Adhesive bands adhere the edge portions and the central portion is removable from the edge portions along the tear lines.

U.S. Pat. No. 4,850,612, issued to D. J. Instance on Jul. 25, 1989, discloses a label with front and back covers and a tear line across a pair of panels and the remaining panels being removable from covers through a free edge of the covers.

U.S. Pat. No. 4,850,613, issued to D. J. Instance on Jul. 25, 1989, discloses a label comprising a strip with panels and fold lines and the edges of one panel are adhered to form a pocket. A tear off portion is separate from a rear cover and is insertable into the pocket after use.

U.S. Pat. No. 4,927,179, issued to B. A. Ehret et al. on May 22, 1990. discloses a shipping label with a price tag section that has a dimension less than the corresponding dimension of the shipping label. The label has a first ply of release liner material and a second ply of label stock with pressure sensitive adhesive on one side thereof.

U.S. Pat. No. 4,955,640, issued to M. W. Anderson on Sep. 11, 1990, discloses a business form suitable for use as a packing list or invoice attached to a package and which has a portion for address information. The form is Z-folded and is capable of including both variable and non-variable information.

SUMMARY OF THE INVENTION

The present invention relates to a distribution label or like business form that is used to provide the means for a distribution center to print a "ship-to" or address label and to print a label including the contents of a given package or container all in one pass through a printer and to enable the distribution label to stay together or to be complete throughout the transit of the package or container to its final destination.

The invention is directed to a distribution label comprising a facestock having an adhesive on the back side thereof and a liner adhered by means of said adhesive to the back side of the facestock, the facestock including a first line of perforations therein and spaced from one edge of the facestock to form a first label portion, a slit in the facestock and spaced from the first line of perforations to form a second label portion, a second line of perforations in the facestock and spaced from the first line of perforations, a third line of perforations in the facestock and spaced from the second line of perforations to form a third label portion, the slit and the second line of perforations being spaced from each other and the slit permitting removal of a portion of the facestock from the liner to form a first edge portion of the facestock, and a slit in the liner adjacent the third line of perforations permitting removal of a portion of the liner from the facestock to form a second edge portion of the facestock, the first label portion and the second label portion being folded at the first line of perforations and at the second line of perforations, respectively, the distribution label being adhered to a package by means of the first edge portion and by means of the second edge portion.

A first modification of the structure of the invention includes an additional label portion used for data or information.

A second modification of the invention includes a label portion and a paper or like material portion used for data or information.

In accordance with the above discussion, a principal object of the present invention is to provide an improved business form for use on packages or containers.

Another object of the present invention is to provide a business form that incorporates all required labels into one usable form.

An additional object of the present invention is to provide a folded-under label that protects certain portions of the label during transit of a container or package.

A further object of the present invention is to provide a distribution label that accommodates ease of extracting label portions from the label.

Additional advantages and features of the present invention will become apparent and fully understood from a reading of the following description taken together with the annexed drawing.

DESCRIPTION OF THE PREFERRED EMBODIMENT

Prior to describing the invention in detail, it is noted that in delivery or distribution operations, it is preferred to secure a record copy of the information or data concerning the delivery or distribution to a package or article.

Figure 1:
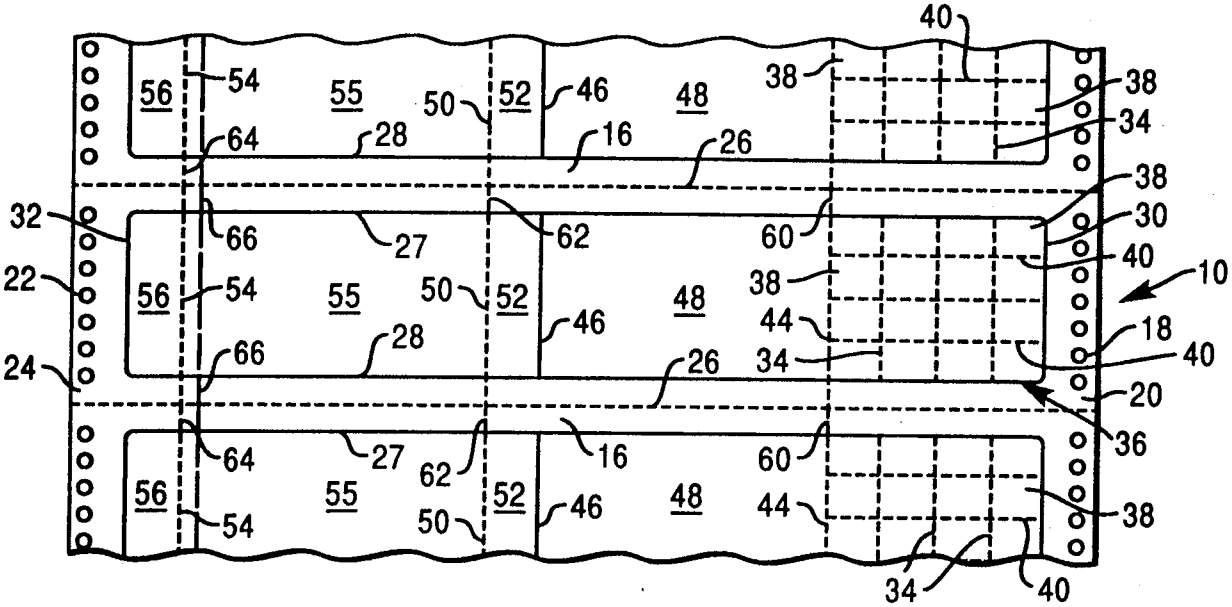
FIG. 1 is a top or plan view of structure for a business form incorporating the subject matter of the present invention.
Figure 2:
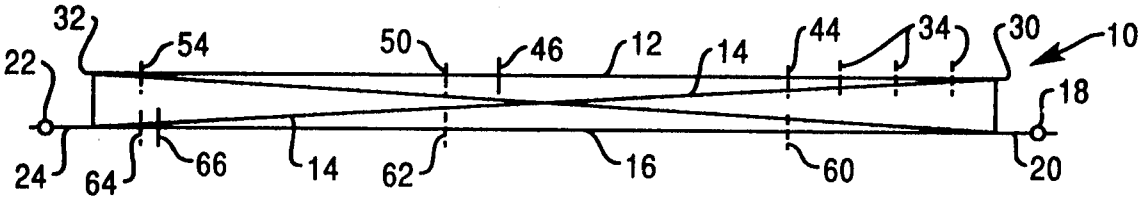
FIG. 2 is an end view of the business form with the plies being separated in exaggerated manner to show the construction.

Referring now to FIGS. 1 and 2 of the drawing, there are shown a top or front plan view of a series of business forms 10, commonly referred to as continuous type forms of a web of material, and an end view of the business form which incorporate the subject matter of and which show the structure of the present invention.

A preferred arrangement or construction of the business form 10 includes a top ply or sheet 12 that is called a facestock and is made of paper material and which may be referred to as 50 pound Electronic Data Processing (EDP) paper. The top ply or sheet 12 has a layer of permanent type, pressure-sensitive adhesive 14 on the underside thereof and which adhesive provides the means for adhering the sheet 12 to a release liner 16. The release liner 16 is made of 50 pound paper material. Of course, other materials suitable for the business form may be used.

The release liner 16 has a plurality of pin feed holes 18 in a right side margin 20 of the liner and a plurality of pin feed holes 22 in a left side margin 24 of the liner. Each of the release liners 16 is attached to an adjacent liner by means of a horizontal line of perforations or line of weakening 26 (FIG. 1) which extends from the right hand edge to the left hand edge of the liner.

The top ply 12 is generally rectangular in shape (FIG. 1) and covers a substantial portion of the underlying liner 16. All four edges of the top ply 12 are short of or spaced from respective edges of the liner 16. More specifically, the upper and lower edges 27 and 28 of the top ply 12 are spaced from the adjacent line of perforations 26, the right hand edge 30 is spaced from the pin feed holes 18 in the margin 20 of the liner 16, and the left hand edge 32 is spaced from the pin feed holes 22 in the margin 24 of the liner 16.

A plurality of vertical perforated lines, as 34, are provided in and spaced from the right hand edge 30 of the top ply 12 to form a price tag or like portion 36 (FIG. 1) of the top ply. The price tag portion 36 of the top ply 12 is divided into smaller portions by respective lines of perforations, as 34 and 40, to form a plurality of price tags 38 and which price tags occupy at least a portion of the top ply. Of course, the number and arrangement of the price tags 38 may be altered to suit different applications or uses. A vertical line of perforations 44 is provided in and spaced from the right hand edge 30 of ply 12 to define the right hand portion 36 of the top ply 12. A slit line 46 is provided in the top ply 12 at approximately the center of the business form 10 and forms with perforated line 44 a centrally located panel 48 (FIG. 1) on which is printed data or other information. A perforated line 50 is provided in and is spaced from the slit line 46 in the top ply 12 and forms one adhering edge portion 52 of the top ply 12, and a perforated line 54 is provided in and spaced from the left hand edge 32 of the top ply 12. The dimension or width of the adhering edge portion 52 from the slit 46 to the perforated line 50 is designed or calculated so as to provide a "quick-release" of the portion 52 from the liner 16 upon folding the liner 16 at the perforated line 62. The portion of the top ply 12 between the perforated line 50 and the perforated line 54 forms an address or like portion 55 (FIG. 1).

The release liner 16 has a perforated line 60 therein aligned with the perforated line 44 (FIG. 2) in the top ply 12, a perforated line 62 aligned with the perforated line 50, and a perforated line 64 aligned with the perforated line 54. A slit line 66 is provided in the release liner 16 and is spaced to the right from the perforated line 64. The portion of the top ply 12 from the edge 32 to a line that is in line with slit 66 of the liner 16 forms a second adhering portion 56 of the top ply 12.

The dimensions of the top ply 12 relative to the release liner 16 are provided so that a space exists between adjacent top plies formed by edges 27 and 28 (FIG. 1). The space between successive top plies 12 allows for ease of folding the business forms 10 along the horizontal perforated lines 26 and such space also prevents adhesive from oozing out from under one top ply to an adjacent top ply at the fold lines 26.

Figure 3:
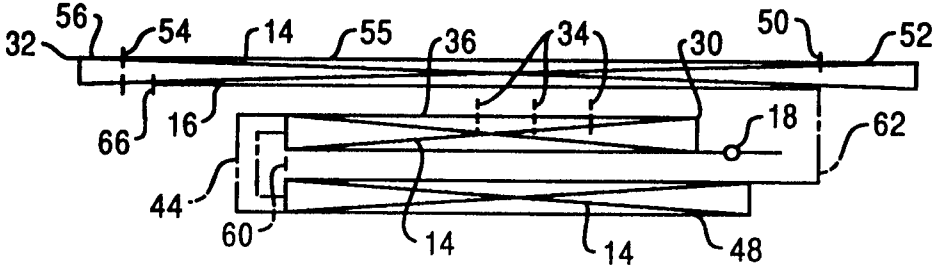
FIG. 3 is an end view of the business form of FIGS. 1 and 2 in a folded condition for applying to a package or other article.

FIG. 3 shows, in diagrammatic form, a folded condition of the business form 10 wherein the right hand portion 36 containing the price tags 38 is folded at the perforated line 44 under the central portion 48. The central portion 48 with the portion 36 is then folded at perforated line 50 under the address portion 55. The perforated line 44, the perforated line 60 and the perforated line 62 are shown in phantom so as to enable illustration of the folded parts. The business form 10 is applied to a package or article by means of the adhering edge portions 52 and 56 for transit.

Figure 4:
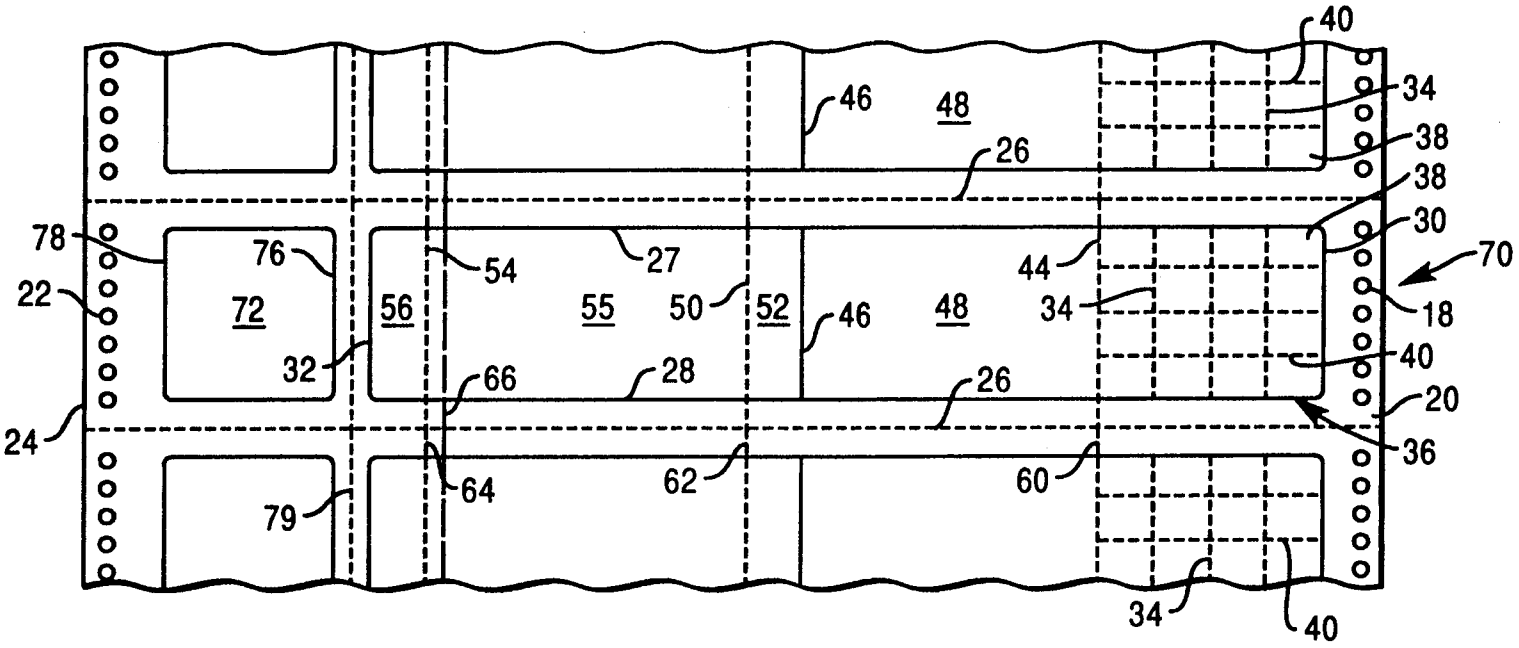
FIG. 4 is a top or front plan view of a first modified arrangement of the business form of the present invention.
Figure 5:
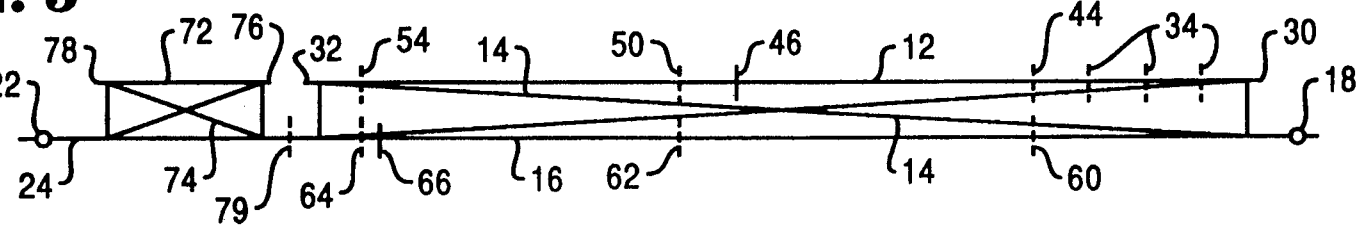
FIG. 5 is an end view showing the construction of the first modified form.

FIGS. 4 and 5 illustrate a second embodiment of the invention wherein a business form 70 is constructed similar to the form 10 shown in FIGS. 1 and 2 and further includes an additional label portion 72 at the left side of the form 70 and which portion could be used for additional data or information. The label portion 72 is adhered to the release liner 16 by means of permanent type, pressure-sensitive adhesive 74 (FIG. 5). The label portion 72 is rectangular in shape with an edge 76 spaced from edge 32 of portion 56 of the top ply 12 and an edge 78 spaced from the pin feed holes 22 of the liner 16. A perforated line 79 is provided in the liner 16 so that the label portion 72 may be separated or detached from the top ply 12.

Figure 6:
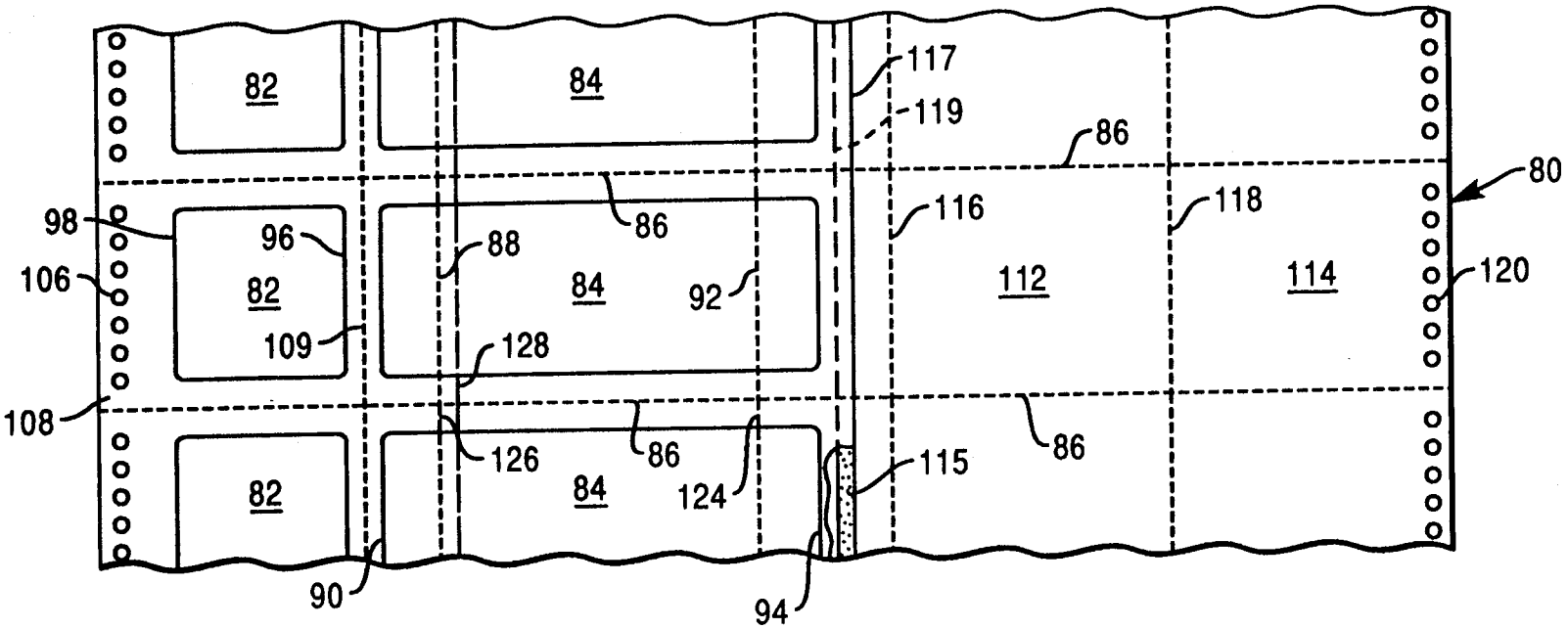
FIG. 6 is a top or front plan view of a second modified arrangement of the business form.
Figure 7:
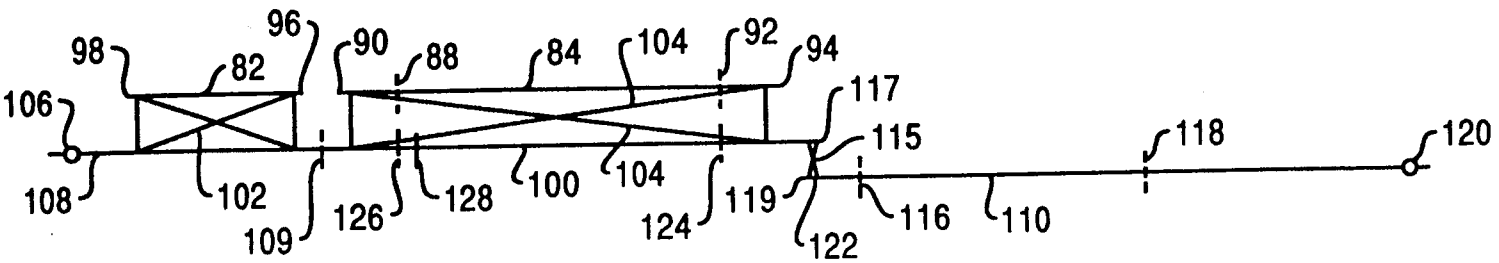
FIG. 7 is a end view showing the construction of the second modified form.

FIGS. 6 and 7 illustrate a third embodiment of the invention wherein a business form 80 is similar in part to the forms 10 and 70. The business form 80 is one of a plurality of continuous forms and includes a first label portion 82 and a second label portion 84 as top plies of the form. The first label portion 82 is used for data or other information and the second label portion 84 is used for addresses. The adjacent business forms 80 are attached by means of a horizontal perforated line 86 (FIG. 6). The second label portion 84 has a first vertical perforated line 88 spaced from the left hand edge 90 and a second vertical perforated line 92 spaced from the right hand edge 94. The first label portion 82 is rectangular in shape with an edge 96 spaced from edge 90 of the second label portion 84 and an edge 98 spaced from pin feed holes 106 of a release liner 100. The label portion 82 is adhered to the release liner 100 by means of pressure-sensitive adhesive 102 and the label portion 84 is adhered to the release liner 100 by adhesive 104 (FIG. 7). The plurality of pin feed holes 106 are provided in a left margin 108 of the release liner 100 adjacent the label portion 82. A vertical perforated line 109 is provided in the release liner 100 to enable separation of the first label portion 82 from the second label portion 84.

A paper ply 110 is provided as the right hand portion of the business divided into portions 112 and 114 by means of vertical perforated lines 116 and 118 and the horizontal perforated lines 86. The paper ply 110 is made of 20 pound bond paper. The portions 114 include a series of pin feed holes 120 adjacent the right hand edge thereof.

A glue line 115 is located adjacent a right hand edge 117 of the liner 100 and adjacent a left hand edge 119 of the paper ply 110 to secure the liner and the paper ply along a portion 122 of the ply 110 (FIG. 6).

The overlap area or portion 122 is located to the left of the perforated line 116 of the paper ply 110 and to the right of a perforated line 124 of the liner 100. The perforated line 124 is aligned with the perforated line 92 (FIG. 7) and to the left of edge 94 of label portion 84. A perforated line 126 is located approximately at the center of the liner 100 and to the right of edge 90 of label portion 84 and is aligned with the perforated line 88 of portion 84 (FIG. 7). The release liner 100 also has a slit line 128 adjacent and to the right of the perforated line 126.

In the application or use of the distribution label, the entire continuous web having forms, as 10 (FIG. 1), is printed with the required information and is bursted at the horizontal perforated lines 26. The right hand portion 36 with the price tags 38 is folded at the perforated lines 44 and 60 under the central portion 48, and the central portion 48 with folded portion 36 is folded at the perforated lines 50 and 62 under the address portion 55.

When the top ply 12 of the form 10 is folded at perforated line 50, the vertical slit line 46 in the top ply provides for and allows the portion 52 to be released from the liner 16 at that location and to expose adhesive 14 under edge portion 52. The liner portion containing the pin feed holes 22 and the margin 24 is removed at slit line 66 to expose adhesive 14 under edge portion 56. The distribution label with portions 36 and 48 folded under portion 55 is applied to a package or other article and is secured thereto by means of the adhesive 14 under edge portion 52 at the right side and under edge portion 56 at the left side of the address portion 55. The price tag portion 36 and the data or information portion 48 are secured and protected under the address portion 55.

When it is desired to remove the distribution label from the package, the address portion 55 (with portions 36 and 48) is grasped at the top and pulled downward along the perforated lines 50 and 54 to retrieve the price tag portion 36 and the data portion 48. The portions 52 and 56 of the top ply 12 remain with the package by reason of adhesive 14. The price tags 38 are then removed from the liner 16, as required, along with the data portion 48, as desired. The address portion 55 with the portion of the liner 16 still intact thereunder could be reused, if desired.

It is thus seen that herein shown and described is a business form that is supplied as a unit set and includes a top ply and a release liner and serves as a distribution label for a package or article that is in transit from one location to another location.

The distribution label incorporates all the required label portions into one usable business form and the "tuck-under" design provides for certain portions of the label to be folded under the address label for safekeeping during transit. The distribution label can be any form, shape or configuration as desired by the customer. The dimensions and size of the label are limited only by equipment or printer specifications, and various types of printers or printing methods may be used. The pressure-sensitive materials are provided as required by the customer. The several label portions stay together throughout the transit of the package or container from origin to final destination, thereby eliminating the need for matching of labels.

The distribution label of the present invention includes features and/or advantages that provide for more label area in the price tag portion, that provide for easier or simpler use or application of the label on packages or other containers, that enables ease of extracting pricing tags or label portions, and that provides for a reusable address or shipping portion of the label.

The construction of the business form of the present invention enables the accomplishment of the objects and advantages mentioned above, and while a preferred embodiment and modifications have been disclosed herein, other variations thereof may occur to those skilled in the art. It is contemplated that all such variations not departing from the spirit and scope of the invention hereof are to be construed in accordance with the following claims.

What is claimed is:

1. A distribution label comprising:

facestock material having adhesive on the back side thereof, and liner material underlying the entire surface of and adhered by means of said adhesive to the back side of the facestock material, said facestock material including a first line of perforations therein and spaced from one edge of the facestock material and forming a first label portion, a slit in said facestock material and spaced from said first line of perforations and forming a second label portion, a second line of perforations in the facestock material and spaced from said first line of perforations, a third line of perforations in said facestock material and spaced from said second line of perforations and forming a third label portion, the slit and the second line of perforations in said feedstock material being adjacent and spaced from each other and the slit and the second line of perforations being arranged for providing release of a portion of the facestock material from the liner material and forming a first edge portion of the facestock material for adhering to a package, said first edge portion being formed upon folding said first label portion along said first line of perforations under said second label portion and upon folding said second label portion along a line aligned with said second line of perforations under said third label portion, and a slit in the liner material adjacent the third line of perforations in the facestock material permitting removal of a portion of the liner material from the facestock material and forming a second edge portion of the facestock material for adhering to the package, the first, second and third label portions of the distribution label being adhered to the package by means of the first edge portion and by means of the second edge portion, the removal of said third label portion along said second and said third lines of perforations in said facestock material exposing said first label portion and said second label portion for retrieval thereof and leaving the first edge portion and the second edge portion adhered to the package.

2. The distribution label of claim 1 wherein said slit in said facestock material is spaced from said second line of perforations at a dimension whereby said first edge portion is quickly released from said liner material upon folding said second label portion at the location of said second line of perforations in said facestock material.

3. The distribution label of claim 1 wherein said first label portion includes a plurality of lines of perforations permitting removal of individual portions of said first label portion.

4. The distribution label of claim 1 wherein said liner material includes horizontal lines of perforations enabling separation of one distribution label from an adjacent label.

5. The distribution label of claim 1 wherein said liner material includes a first line of perforations aligned with said first line of perforations in said facestock material and along which said liner material is folded with said first label portion.

6. The distribution label of claim wherein said liner material includes a second line of perforations aligned with said second line of perforations in said facestock material and along which said liner material is folded with said second label portion.

7. The distribution label of claim 1 wherein said liner material includes a third line of perforations adjacent said slit in said liner material and aligned with said third line of perforations in said facestock material.

8. The distribution label of claim 1 wherein said liner material includes pin feed holes in the margins thereof for continuous form feeding.

9. The distribution label of claim 4 wherein the edges of said facestock material are spaced from said horizontal lines of perforations.

10. The distribution label of claim 1 including a fourth label portion spaced from said third label portion.

11. The distribution label of claim 10 wherein said liner material includes a fourth line of perforations permitting separation of said fourth label portion from said third label portion.

12. A distribution label comprising:

facestock material having adhesive on the back side thereof, liner material underlying the entire surface of and adhered by means of said adhesive to the back side of the facestock material, and paper material divided into portions and having a line of adhesive along one edge thereof for securing said one edge to and edge of said liner material, said facestock material having a first line of perforations therein and spaced from one edge of the facestock material and having a second line of perforations therein and spaced from the opposite edge of the facestock material and forming one label portion, said liner material having a first line of perforations therein and adjacent and spaced from said line of adhesive and forming a first edge portion of the facestock material for adhering to a package, said first edge portion being formed upon folding of said liner material at said first line of perforations therein, said liner material having a slit therein adjacent and spaced from said second line of perforations in said facestock material and forming a second edge portion of the facestock material for adhering to the package upon removal of a portion of said liner material along said slit, the paper material being folded at the first line of perforations in said liner material and under said one label portion of said facestock material, and the one label portion and the paper material of the distribution label being adhered to the package by means of the first edge portion and the second edge portion, the removal of said one label portion along said first and said second lines of perforations in said facestock material and the removal of said liner material along said first line of perforations and along said slit in said liner material exposing said portions of said paper material for retrieval thereof and leaving the first edge portion and the second edge portion adhered to the package.

13. The distribution label of claim 12 wherein said paper material includes a first line of perforations spaced from said line of adhesive and an overlap portion adjacent said first line of perforations in said paper material, said first line of perforations enabling folding of said paper material therealong and under said one label portion of said facestock material.

14. The distribution label of claim 12 wherein said paper material includes a second line of perforations enabling folding of said paper material therealong and under said one label portion of said facestock material thereby permitting removal of individual portions of said paper material.

15. The distribution label of claim 12 wherein said liner material includes horizontal lines of perforations enabling separation of one distribution label from an adjacent label.

16. The distribution label of claim 12 wherein said facestock material includes a second label portion spaced from said one label portion and having adhesive on the back side thereof, and liner material adhered by means of said adhesive to said back side of said second label portion of said facestock material.

17. The distribution label of claim 16 wherein said liner material includes a second line of perforations between said one label portion and said second label portion and permitting separation of said second label portion from said one label portion.

18. A distribution label comprising facestock material having adhesive on the back side thereof, and liner material covering the surface of and adhered by means of said adhesive to the back side of the facestock material, said facestock material including a slit therein and spaced from one edge of the facestock material and forming a first label portion, a first line of perforations in the facestock material and adjacent and spaced from said slit in an arrangement to form an adhering edge portion of the facestock material for adhering to a package, a second line of perforations in the feedstock material and spaced from said first line of perforations and forming a second label portion, a slit in said liner material adjacent said second line of perforations in said facestock material permitting removal of a portion of the liner material from the facestock material and forming a second adhering edge portion of the facestock material for adhering to the package, a line of perforations in said liner material aligned with said first line of perforations in said facestock material, the spacing of said slit in said facestock material from said first line of perforations in said facestock material being at a distance for providing a quick release of said first mentioned adhering edge portion from said liner material upon folding of said liner material along said line of perforations therein, the first label portion being folded at said line of perforations in said liner material and under said second label portion, the first label portion and the second label portion of the distribution label being adhered to the package by means of the first and the second adhering edge portions, the removal of said second label portion along said first and said second lines of perforations in said facestock material exposing said first label portion for retrieval thereof and leaving the edge portions of the facestock material adhered to the package.

* * * * *

UNITED STATES PATENT AND TRADEMARK OFFICE

CERTIFICATE OF CORRECTION

PATENT NO. : 5,147,699

DATED : September 15, 1992

INVENTOR(S) : Jovona C. Browning et al.

It is certified that error appears in the above-identified patent and that said Letters Patent is hereby corrected as shown below:

Column 7, line 54, after "claim" insert --1--.

Column 8, line 15, delete "and" and substitute --an--.

Column 9, line 20, delete "feedstock" and substitute --facestock--.

Signed and Sealed this

Seventh Day of December, 1993

*Attest:*

*Attesting Officer*

Bruce Lehman

BRUCE LEHMAN

*Commissioner of Patents and Trademarks*